United States Patent [19]

Hoffman et al.

[11] 4,221,547

[45] Sep. 9, 1980

[54] RESILIENT MOUNT FOR DISHWASHER MOTOR AND PUMP ASSEMBLY

[75] Inventors: Robert E. Hoffman; Timothy J. Skinner; James M. Woolley, all of Dayton, Ohio

[73] Assignee: White Consolidated Industries, Inc., Cleveland, Ohio

[21] Appl. No.: 943,137

[22] Filed: Sep. 18, 1978

[51] Int. Cl.[2] ..... F04B 21/00

[52] U.S. Cl. ..... 417/363; 134/186; 137/565

[58] Field of Search ..... 68/23.3; 134/186, 188; 417/363, 424, 423 R, 360; 137/565

[56] References Cited

U.S. PATENT DOCUMENTS

| | | | |
|---|---|---|---|
| 2,880,740 | 4/1959 | Peglow | 134/188 |
| 2,973,895 | 3/1961 | Brown et al. | 417/363 |
| 3,044,715 | 7/1962 | Woodson et al. | 241/46 B |
| 3,101,889 | 8/1963 | Tatge | 417/363 |
| 3,242,871 | 3/1966 | Mercer | 417/363 |
| 3,339,867 | 9/1967 | Bayless | 417/363 |
| 3,355,111 | 11/1967 | Barnstead | 134/186 |
| 3,370,608 | 2/1968 | Eisenbrand et al. | 137/565 |
| 3,406,637 | 10/1968 | Perl | 134/188 |
| 3,583,835 | 6/1971 | Coburn, Sr. et al. | 417/360 |
| 3,587,939 | 6/1971 | Nystuen et al. | 137/565 |
| 3,648,931 | 3/1972 | Jacobs | 239/585 |
| 3,825,373 | 7/1974 | Jenkins | 417/363 |
| 3,876,338 | 4/1975 | Jarvis, Jr. et al. | 134/186 |
| 3,906,967 | 9/1975 | Bergeson | 134/186 |

*Primary Examiner*—William R. Cline
*Assistant Examiner*—H. Jay Spiegel
*Attorney, Agent, or Firm*—Pearne, Gordon, Sessions

[57] ABSTRACT

The mounting for a motor-pump housing in the bottom opening of a dishwasher chamber consisting of a one-piece elastomer sleeve formed by a large diameter radially outwardly directed top gasket portion, a frustoconical medial portion and a smaller diameter bottom cylindrical portion. The sleeve medial portion defines with the pump housing a sump for receiving and directing water exiting the chamber and wherein the medial portion is free to flex to substantially obviate the transmission of vibrational energy to the dishwasher casing.

1 Claim, 5 Drawing Figures

RESILIENT MOUNT FOR DISHWASHER MOTOR AND PUMP ASSEMBLY

This invention relates to a dishwasher and more particularly to an improved arrangement for resiliently mounting a motor-pump assembly to a dishwasher tub.

In the manufacture of domestic appliances such as dishwashers it is desirable to provide vibration-dampening means for reducing the transmission of vibrations from the pump-motor assembly to the dishwasher tub. An example of a dishwasher, capable of absorbing operational vibrations, is the pump-motor mount disclosed in U.S. Pat. No. 2,880,740 issued Apr. 7, 1959 to Peglow disclosing a dishwasher elastomeric ring positioned in registry with the opening in the bottom of a dish chamber. The Peglow specification states that the elastomeric ring acts in tension to suspend a motor-impeller unit from the bottom wall of the dish chamber.

It is the object of the present invention to provide an improved resilient mounting means for suspending a pump-motor assembly in a dishwashing chamber bottom opening defined by a radially inwardly directed annular flange. The mounting means, positioned between the motor-pump housing and the bottom opening, is in the form of a one-piece sleeve including a large diameter radially outwardly directed top gasket portion, a frusto-conical medial portion and a smaller diameter bottom cylindrical portion. The top gasket portion provides sealing means retaining same in nested overlying relation with the annular flange, together with means sealingly retaining the sleeve smaller diameter bottom cylindrical portion in circumscribing relation with the motor-pump lower housing portion. The sleeve medial portion tapers axially downwardly and radially inwardly from the sleeve top portion to the sleeve bottom portion so as to dispose the sleeve bottom cylindrical portion at a substantial distance below the chamber bottom opening. Applicants' medial portion defines with a planar portion and an upper small diameter wall portion of the pump-motor housing a sump wherein the sleeve frusto-conical medial portion is positioned in outer radial spaced relation with inlet means of the pump. Thus, water exiting from the dishwasher chamber is directed in funnel-like fashion by the frusto-conical medial portion and the motor-pump housing planar portion in substantially uninterrupted flow through said sump into the pump inlet. Further to the invention the sleeve medial portion is formed of uniform thickness so as to be substantially thinner than the sleeve top and bottom portions whereby the frusto-conical medial portion is free to flex allowing the pump-motor assembly to move in directions coaxially, laterally and torsionally with respect to a vertical axis of the dishwasher. The result is to substantially obviate the transmission of vibrational energy from the motor-pump to the dishwasher tub for quiet operation of the dishwasher and for improved long life of the appliance.

Further objects and advantages of the present invention will be apparent from the following description, reference being had to the accompanying drawings wherein a preferred embodiment of the present invention is clearly shown.

Figure 1:
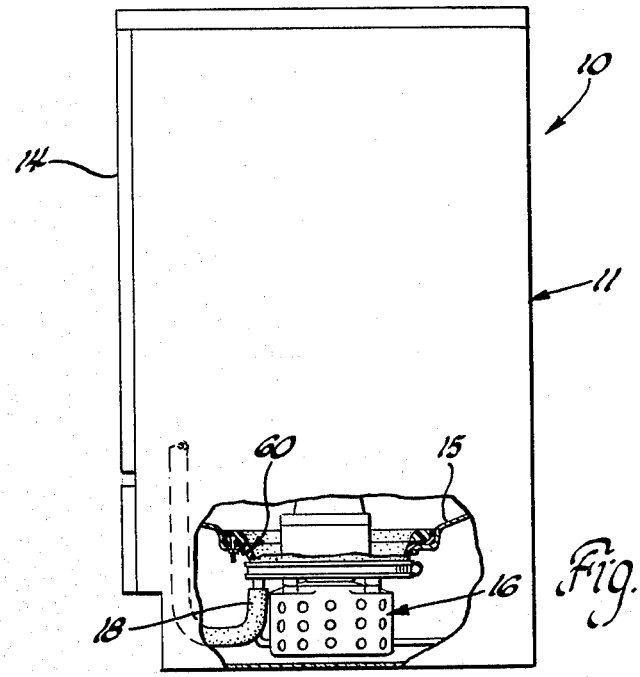
FIG. 1 is a side elevational view with parts broken away, showing the motor-pump assembly supported from a dishwasher tub.
Figure 2:
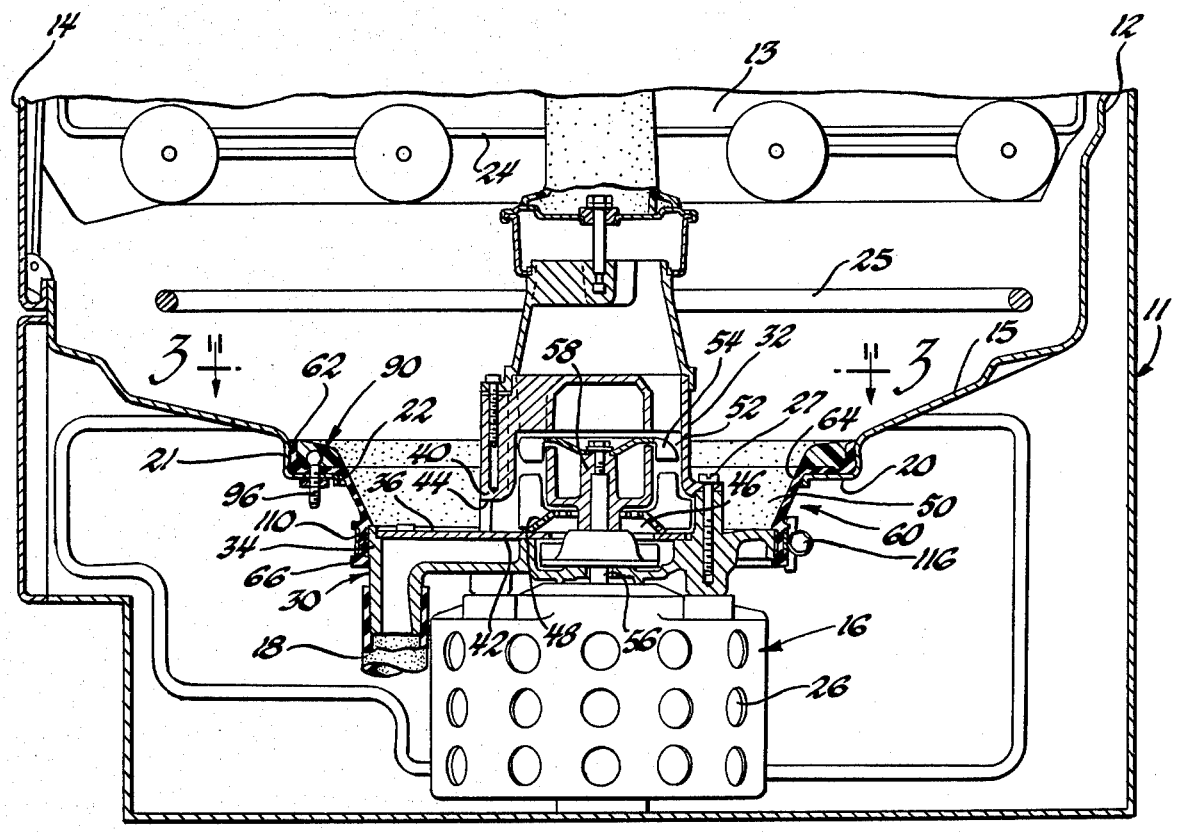
FIG. 2 is an enlarged fragmentary sectional view of the dishwasher showing the internal structure thereof including certain components of the motor-pump assembly resilient mount.

In accordance with this invention, and with reference to FIGS. 1 and 2, a dishwasher 10 includes an outer casing 11 and an inner tub 12 providing an inner dishwashing chamber 13. The outer casing 11 is provided with a front loading access door 14 and a tub sunken bottom portion 15 having a vertically arranged motor-pump assembly 16 of the type taught in the U.S. Pat. No. 3,648,931, issued Mar. 14, 1972, and assigned to the same assignee as this invention. The motor-pump assembly 16 is disposed relative to the internal plumbing of the dishwasher to connect with the drain line partially indicated at 18. The dishwashing inner tub 12 has an opening in the bottom defined by a radially inwardly directed annular shoulder 20, formed by cylindrical upstanding flange 21, defining an opening 22 for receiving the motor-pump assembly 16.

In general, the water distribution system includes a revolvable spray arm (not shown) beneath a lower dish-rack 24 and a rotating spray column or tube (not shown). A heater 25 is shown to provide heat to the wash and rinse water and for adding heat to the wash chamber for drying the dishes.

The pump and motor assembly 16 is comprised of a motor 26 and pump housing 30 supported and connected to the motor. Suitable attaching means such as long screws 27 extend through the pump housing for fastening the pump and motor into assembled relationship. In general, the pump housing 30 includes a vertically extending upper small diameter wall portion 32 and a vertically extending lower larger diameter wall portion 34 supported by a substantially horizontal planar portion or support plate 36. The pump housing upper wall portion 32 has a flange 40 including groups of circumferentially spaced fingers depending therefrom defining pump inlet means in the form of opening 44. A flow diverter element 46 includes a surface or ramp 48 inclined upwardly from the support plate 36 for diverting fluid from sump 50 into inlet opening 44 to cylindrical pumping chamber 52 containing axial flow impeller 54 of the pump 30. The impeller 54 is secured to the upper end of rotatable motor shaft 56 extending through a bore in pump central hub 58. Radially extending blades of the impeller effect a desired pumping action within the pumping chamber 52.

The dishwasher sump 50 is defined by applicants' onepiece elastomer sleeve, generally indicated at 60, positioned between the pump housing means 30 and the bottom opening 22. The one-piece elastomer sleeve 60 is formed by a large diameter radially outwardly directed top gasket portion 62, a frustoconical medial portion 64, and a smaller diameter bottom cylindrical portion 66.

Figure 4:
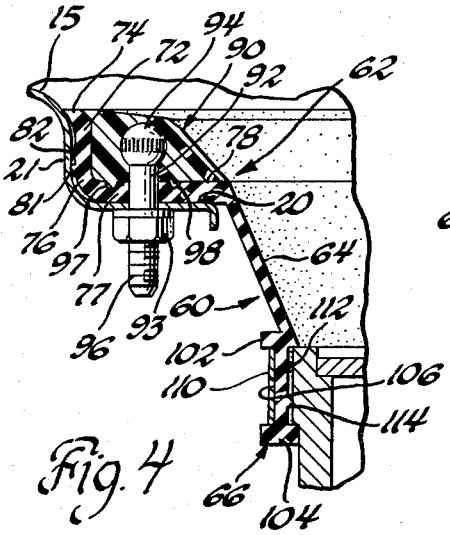
FIG. 4 is a still further enlarged, fragmentary vertical sectional view taken along the line 4—4 of FIG. 3.
Figure 5:
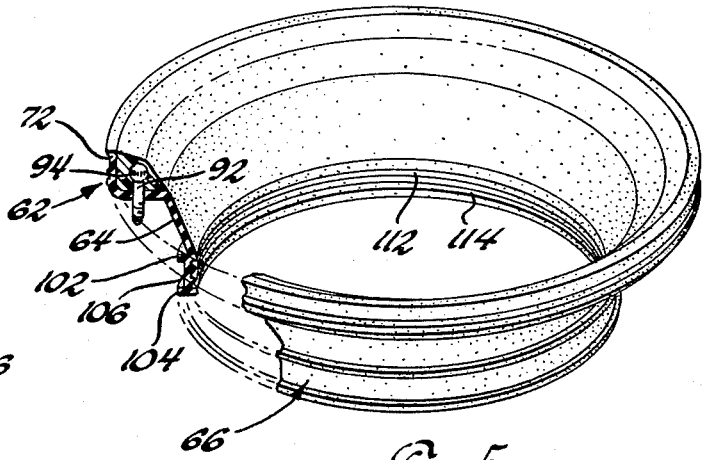
FIG. 5 is an isometric view of the mounting sleeve employed in the invention, with parts broken away.

As best seen in FIG. 4, the top gasket portion 62 has a generally right-angled cross section. The portion 62 includes an upstanding annular collar 72 with an upper radially outward formed lip 74, an intermediate radius 76 having a generally flat ring 77 defining an inner end supporting ledge surface 78 generally perpendicular to the axis of the motor-pump and interconnecting the frusto-conical medial portion 64 and the upstanding collar 72. The upstanding annular collar 72 outer surface is provided with a pair of annular beads 81 and 82 engageable in a sealing manner with the upstanding side or cylindrical flange 21. In this manner the top gasket portion is supported in a fluid tight nested or sealed conforming relation with the shoulder 20 and upstanding 21 flanges.

Figure 3:
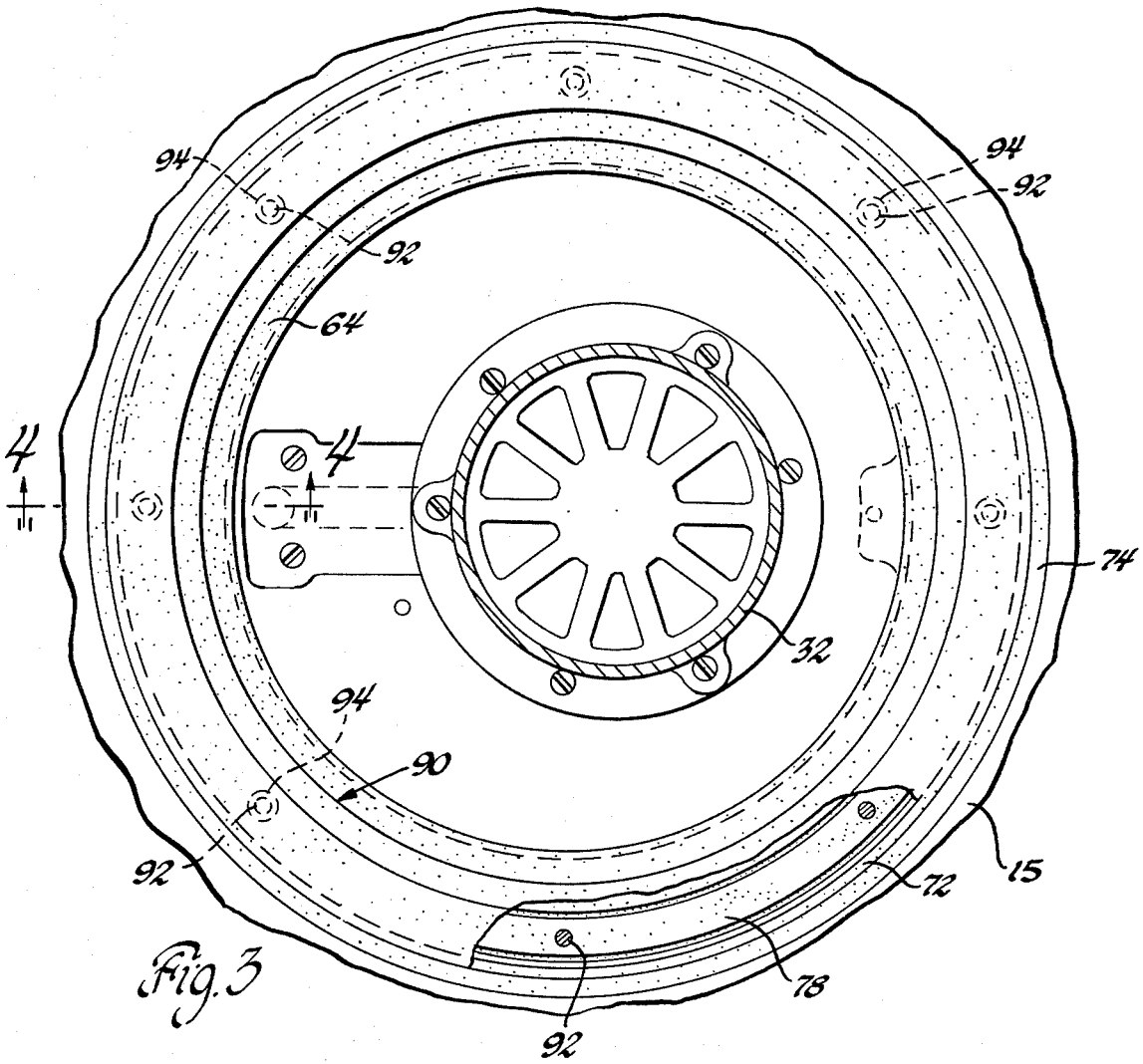
FIG. 3 is an enlarged fragmentary view taken along line 3—3 of FIG. 2, partly in elevation with parts broken away to show the improved mounting arrangement of this invention.

In the disclosed form an upper retaining means, in the form of a plastic seal retainer ring 90, is preferably molded of suitable plastic or phenolic material. The ring 90 includes a plurality of pin inserts 92 equally spaced with the pins having an upper spherical portion 94 embedded in the molded ring and a lower threaded shank portion 96 extending downwardly therefrom. With reference to FIG. 3 it will be seen that the shoulder flange 20 includes a plurality of holes 98 formed in the flange through which the depending threaded shank portions 96 of the pin inserts 92 extend to receive fastening nuts 93 to provide a fastening arrangement of the sleeve upper gasket portion 62 to the tub 12.

As best seen in Fig. 4, the seal ring 90 is provided with a pair of annular beads 97, 98 arranged on either side of the fastening pins 92 with the beads 97 and 98 being drawn into liquid sealing or penetrating relationship with the sump flange.

The bottom cylindrical portion 66 is formed having a generally I-shaped cross section with upper 102 and lower 104 flanges defining therebetween on annular recess 106 receiving a lower connecting means. In the form shown a metal band 110 encircles the bottom cylindrical portion 66 and is received in the recess 106. A pair of annular beads 112 and 114 are formed on the inner surface of bottom portion 66 which upon tightening the band 110 by a conventional clamping bolt 116 the beads 112 and 114 are compressed against the outer surface of the lower pump housing 34 to provide a fluid-tight seal between the sleeve bottom portion 66 and the motor pump.

While the embodiment of the present invention as herein disclosed constitutes a preferred form, it is to be understood that other forms might be adopted.

The embodiments of the invention in which an exclusive property or privilege is claimed are defined as follows:

1. In a domestic dishwasher including casing means forming a dishwashing chamber having an opening in the bottom thereof defined by a radially inwardly directed annular flange, mounting means resiliently suspending a motor-pump assembly in said bottom opening from said annular flange, housing means for the pump of said assembly, said pump housing means including a vertically extending upper small diameter wall portion and a vertically extending lower larger diameter wall portion separated by a substantially horizontal planar portion, said pump housing upper wall portion having pump inlet means located therein, the improvement wherein; said mounting means including a one-piece elastomer sleeve positioned between said pump housing means and said bottom opening, said one-piece sleeve formed by a large diameter radially outwardly directed top gasket portion, a frustoconical medial portion and a smaller diameter bottom cylindrical portion; means sealingly retaining said top gasket portion in nested overlying relation with said annular flange, means sealingly retaining said smaller diameter bottom cylindrical portion in circumscribing relation with said pump larger diameter lower housing portion, said medial portion tapering axially downwardly and radially inwardly from said sleeve top portion to said sleeve bottom portion to coaxially connect same so as to dispose said sleeve bottom cylindrical portion at a substantial distance below said bottom opening, said medial portion defining with said pump housing planar portion and said pump housing upper small diameter wall portion a sump wherein said frusto-conical medial portion is positioned in outer radial spaced opposed relation with said pump inlet means, whereby water exiting from said dishwashing chamber is directed in funnel-like fashion by said frusto-conical medial portion and said pump housing planar portion in substantially uninterrupted flow through said sump into said pump inlet means, and said sleeve medial portion being of uniform thickness substantially one-half the thickness of said sleeve top and bottom portions, whereby said sleeve medial portion being free to flex allowing said motor-pump assembly to move in directions coaxially, laterally and torsionally with respect to a vertical axis in said dishwasher so as to substantially obviate the transmission of vibrational energy from said motor-pump assembly to said dishwasher casing means.

* * * * *